US007503117B2

(12) United States Patent
Wetzel et al.

(10) Patent No.: US 7,503,117 B2
(45) Date of Patent: Mar. 17, 2009

(54) ELECTRIC HAIR CUTTING APPLIANCES

(75) Inventors: Matthias Wetzel, Schöneck (DE); Norbert Kreutz, Wehrheim (DE); Daniel Dietzel, Kelkheim (DE); Volker Stenger, Hösbach (DE); Matthias Matern, Steinbach (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 11/325,114

(22) Filed: Jan. 3, 2006

(65) Prior Publication Data

US 2006/0168816 A1 Aug. 3, 2006

Related U.S. Application Data

(63) Continuation of application No. PCT/EP2004/006196, filed on Jun. 9, 2004.

(30) Foreign Application Priority Data

Jul. 3, 2003 (DE) ..... 103 30 205

(51) Int. Cl.
*B26B 19/10* (2006.01)

(52) U.S. Cl. ..... 30/34.1; 30/43.92

(58) Field of Classification Search ..... 30/34.1, 30/43.92, 210, 216, 223; D28/49, 51, 52, D28/53

See application file for complete search history.

(56) References Cited

U.S. PATENT DOCUMENTS

| | | | | |
|---|---|---|---|---|
| 4,393,585 | A | 7/1983 | Nagelkerke | |
| 4,426,776 | A * | 1/1984 | Kakumoto et al. | 30/34.1 |
| 4,845,847 | A * | 7/1989 | Yasunaka et al. | 30/34.1 |
| 4,941,259 | A * | 7/1990 | Wolf | 30/34.1 |
| 5,022,153 | A * | 6/1991 | Baron | 30/34.1 |
| 5,105,541 | A * | 4/1992 | Messinger et al. | 30/34.1 |
| 5,289,636 | A * | 3/1994 | Eichhorn et al. | 30/43.92 |
| 5,701,673 | A | 12/1997 | Ullmann et al. | |
| 5,819,415 | A * | 10/1998 | Bruggers et al. | 30/223 |
| 6,421,922 | B2 * | 7/2002 | Beutel et al. | 30/216 |
| 6,502,312 | B2 | 1/2003 | Beutel et al. | |
| 6,536,116 | B2 | 3/2003 | Fung | |
| 6,684,507 | B2 * | 2/2004 | Lau et al. | 30/34.1 |
| D518,600 | S * | 4/2006 | Ullmann et al. | D28/51 |
| D521,188 | S * | 5/2006 | Ullmann et al. | D28/49 |
| 2003/0106219 | A1 | 6/2003 | Lau | |
| 2006/0168816 | A1 * | 8/2006 | Wetzell et al. | 30/43.92 |
| 2008/0047145 | A1 * | 2/2008 | Dietzel et al. | 30/34.05 |

FOREIGN PATENT DOCUMENTS

| | | |
|---|---|---|
| DE | 31 24 186 | 4/1982 |
| DE | 195 21 299 | 3/1996 |
| DE | 195 31 012 | 10/1996 |
| EP | 0 707 926 | 4/1996 |
| EP | 0 752 298 | 1/1997 |
| EP | 1 216 799 | 6/2002 |
| WO | WO00/37225 | 6/2000 |
| WO | WO 2005/002806 A1 * | 1/2005 |

* cited by examiner

*Primary Examiner*—Hwei-Siu C Payer
(74) *Attorney, Agent, or Firm*—Fish & Richardson P.C.

(57) ABSTRACT

An electric hair cutting apparatus including a casing and a cutter unit secured to the casing.

13 Claims, 5 Drawing Sheets

ELECTRIC HAIR CUTTING APPLIANCES

CROSS-REFERENCE TO RELATED APPLICATIONS

This application is a continuation application of PCT Application No. PCT/EP2004/006196, filed on Jun. 9, 2004 and designating the U.S., which claims priority to German Application No. 103 30 205.0, filed on Jul. 3, 2003.

TECHNICAL FIELD

This invention relates to electric hair cutting appliances.

BACKGROUND

WO 00/37225 describes a hair cutting apparatus including a cutter head mounted on a housing of the apparatus for pivotal motion about an axis. A cutting comb of the cutter head has two associated cutting blades that are adapted to be coupled to a drive element of a drive mechanism. Each of the cutting blades is dependent upon the pivot position of the cutter head. One of the cutting blades is generally disengaged so that only one cutter unit is driven at a time. The axis about which the cutter head is pivotal extends parallel to the cutting edges of the cutting combs or cutting blades. The cutter head is carried at either end in a fork-shaped socket in the housing of the hair cutting apparatus. The pivot axis extends centrally relative to the two cutting elements. Coupling elements are connected to cutting elements of the cutting blades. The coupling elements, for engagement with an eccentric drive, include sloping enlargements to facilitate introduction of the eccentric device in various operating positions. It is necessary to turn off the drive before pivoting the cutter units.

US 2003/0106219 A1 describes another hair cutting apparatus that has a pivotal cutter head with two cutter units, a narrower one and a wider one. The two ends of the cutter head are carried in a casing, with the pivot axis extending normal to a plane formed by the two cutter units. The pivot axis extends centrally relative to the two cutting elements. In order to enable the cutter head to be rotated relative to the casing with the motor turned on, a coupling device is provided. The coupling device temporarily interrupts the driving relationship between motor and shaving unit.

SUMMARY

In certain aspects of the invention, an arrangement is provided that enables an operator of a hair cutting apparatus to rotate a cutter unit about an axis of rotation using the thumb of his or her hand that grips the apparatus. In such aspects, the handling comfort of the hair cutting apparatus can be improved relative to conventional hair cutting apparatuses.

In some embodiments, a drive mechanism for actuation of the cutter unit is disposed so as to act upon a shaving element to be moved (e.g., oscillated). In certain embodiments, the drive mechanism is alternatively or additionally disposed to act upon a component part connected to the shaving element in the proximity of an axis of rotation. In certain embodiments, it is possible to pivot the cutter unit with the drive turned on. This can, for example, help to improve handling of the apparatus.

In certain embodiments, the cutter unit includes a cutting comb and an associated cutting blade, which enable the cutter unit to be used as a hair trimmer or a longhair cutter. In some embodiments, the cutting comb and the cutting blade include teeth with flanks that form the cutting edges.

In some embodiments, two diametrically opposed cutter units are mounted on a carrier body. In such embodiments, the carrier body can be rotated about an axis of rotation extending eccentrically between two cutter units. Rotation of the carrier body relative to a casing of the hair cutting apparatus enables the user to place the desired cutter unit in a working or operative position.

In certain embodiments, two different types of cutter units (e.g., longhair cutter units) are provided. Each of the cutter units can, for example, be placed in an operating state in a predetermined position relative to the casing of the hair cutting apparatus. In some embodiments, the cutter units have widths that differ from one another. The cutter units can, for example, include a cutting comb and an associated cutting blade of different widths. Hence a longhair cutter for shortening longer hair, which has a relatively wide dimension, can be provided along with a relatively narrow contour shaper for cutting precision contours. The relatively wide cutter and the relatively narrow shaper can be brought into respective working positions by pivoting the carrier body. In certain embodiments, the two cutter units are asymmetrically positioned relative to the common axis of rotation. In some embodiments, it is possible to pivot the cutter units (e.g., the relatively wide cutter and/or the relatively narrow shaper) into a working position that is particularly exposed relative to the casing. In such embodiments, the operator can obtain a good view of the working area for the relatively wide cutter and/or the relatively narrow shaper, without substantial interference by the casing or related parts.

Advantageously, the two cutter units can be actuated by a common drive arrangement, which can help to simplify the design and reduce the effort required to assemble the cutting apparatus.

In certain embodiments, the hair cutting apparatus further includes a shorthair cutter unit. In some embodiments, the carrier body is rotatably mounted on the outside (e.g., on an outside surface) of the casing of the hair cutting apparatus equipped with the shorthair cutter unit. In these embodiments, the shorthair cutter unit can be used to produce a relatively close shave, and the cutter unit(s) carried by the carrier body may be designed as longhair cutters of differing widths. In certain embodiments, the cutter unit(s) secured to the carrier body can advantageously be pivoted into their respective operating positions with one hand.

In some embodiments, both the shorthair cutter unit and the cutter unit(s) mounted on the carrier body are driven by a common motor.

In certain embodiments, the carrier body is linearly displaceably mounted on the casing. In such embodiments, the carrier body can be linearly displaced relative to the casing. Such arrangements can help to enable operating positions that are spaced from each other by a wide distance to be selected in a simplified manner.

For enhanced handling comfort, it is possible for the linear and/or rotary movements of the carrier body to be performed by an electric motor.

In some embodiments, the hair cutting apparatus improves the ease of operation of the cutter unit(s) rotatably mounted on the casing. In certain embodiments, for example, the hair cutting apparatus can be operated with only one hand.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
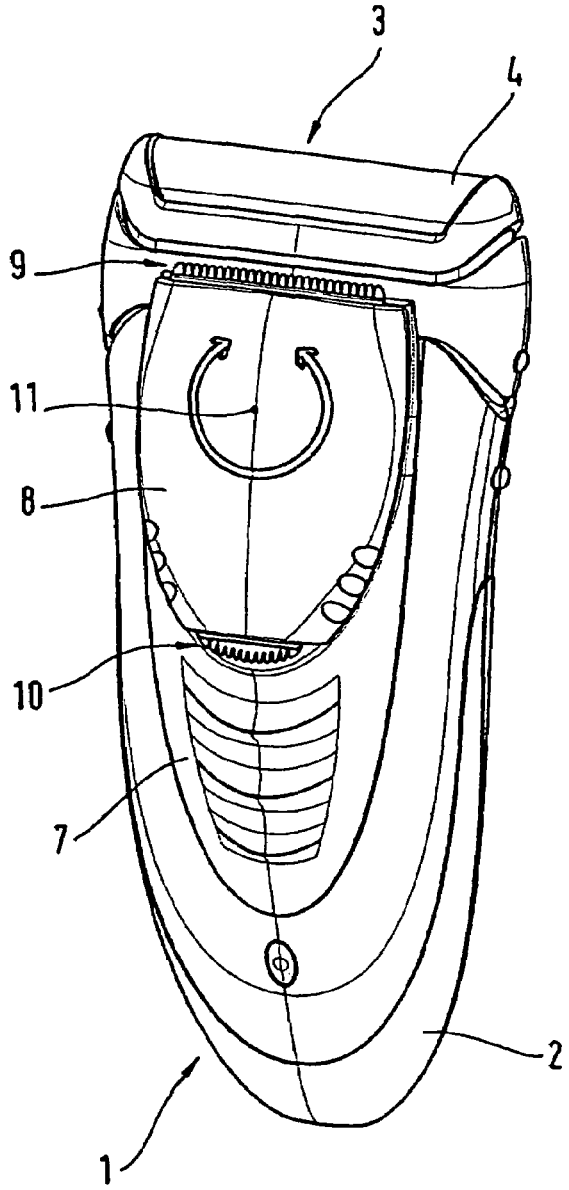
FIG. 1 is a view of an embodiment of the invention in a first operating state.

The perspective view of FIG. 1 shows a dry shaver 1 with a casing 2 and a shorthair cutter unit 3. The shorthair cutter unit 3 includes an outer cutter 4 constructed in the form of a shaving foil beneath which an undercutter (not shown) is moved to and fro in oscillating fashion. The casing 2 accommodates a drive motor (not shown) and, where applicable, electric storage cells (not shown) and/or a power supply (not shown) and charging unit (not shown) for the supply of power to the drive motor. Arranged on a rear side of the casing 2 is an on/off switch 5. The on/off switch 5 controls the supply of power to the drive motor which, when turned on, causes the undercutter of the shorthair cutter unit 3 to oscillate. The motor also drives a drive element 6 protruding from the casing 2. In this arrangement, like the undercutter, the drive element 6 is driven to oscillate parallel to the transverse axis of the dry shaver.

Arranged on the front side of the casing 2 is a slide switch 7 on which a carrier body 8 is mounted. First and a second longhair cutter units 9 and 10, respectively, are secured to the carrier body 8, as shown in FIG. 1. The slide switch 7 is movably mounted to the casing 2 for displacement along the longitudinal axis of the casing 2. The carrier body 8 in turn is pivotably mounted on the slide switch 7 for pivotal motion about an axis of rotation 11 that extends substantially perpendicularly to the front side of the casing 2. The linear displaceability of the slide switch 7 on the casing 2 can be accomplished using any of various techniques, such as slide-type longitudinal guideways.

Figure 7:
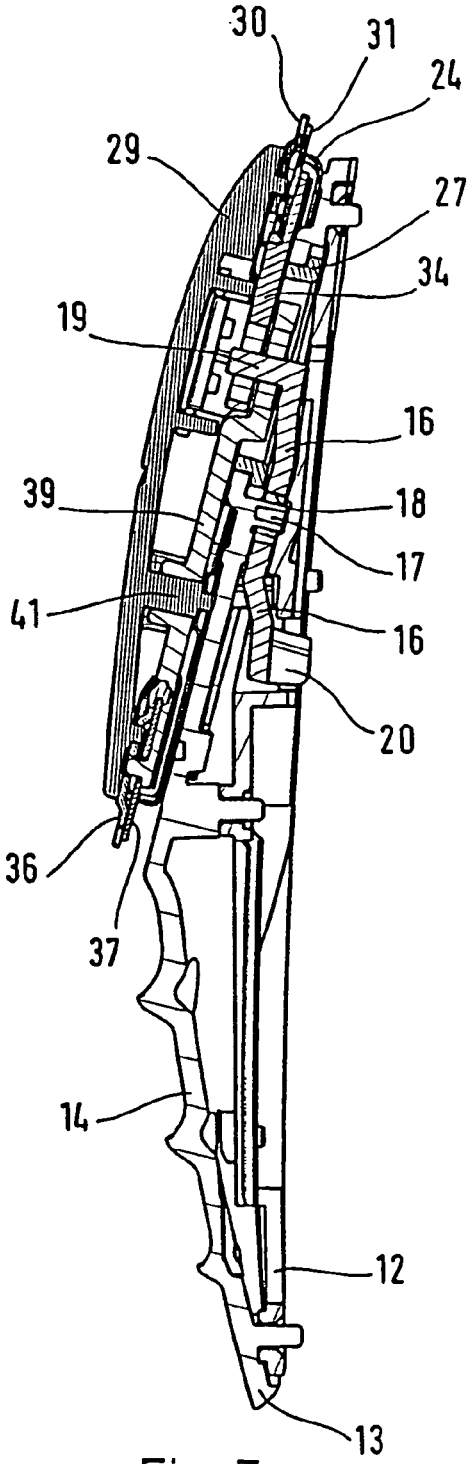
FIG. 7 is an enlarged, longitudinal sectional view of a carrier body mounted on a slide switch.
Figure 8:
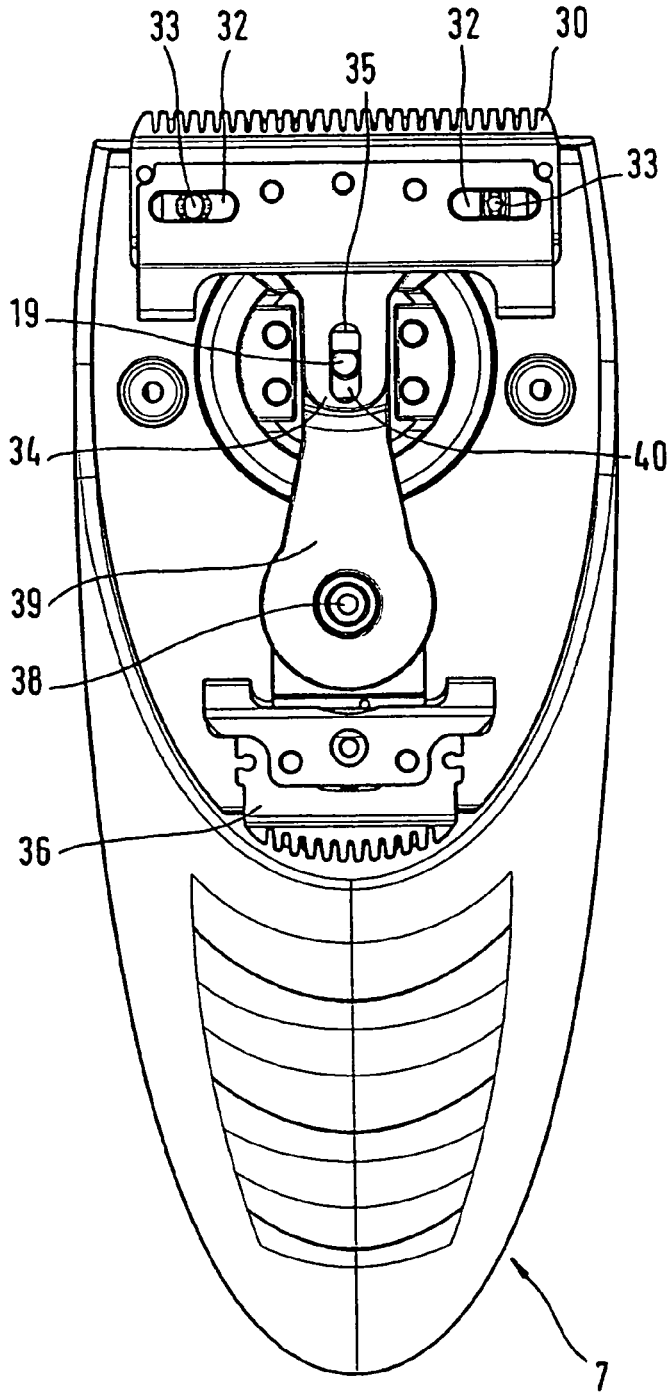
FIG. 8 is a top plan view of FIG. 7 with the carrier body exposed.
Figure 9:
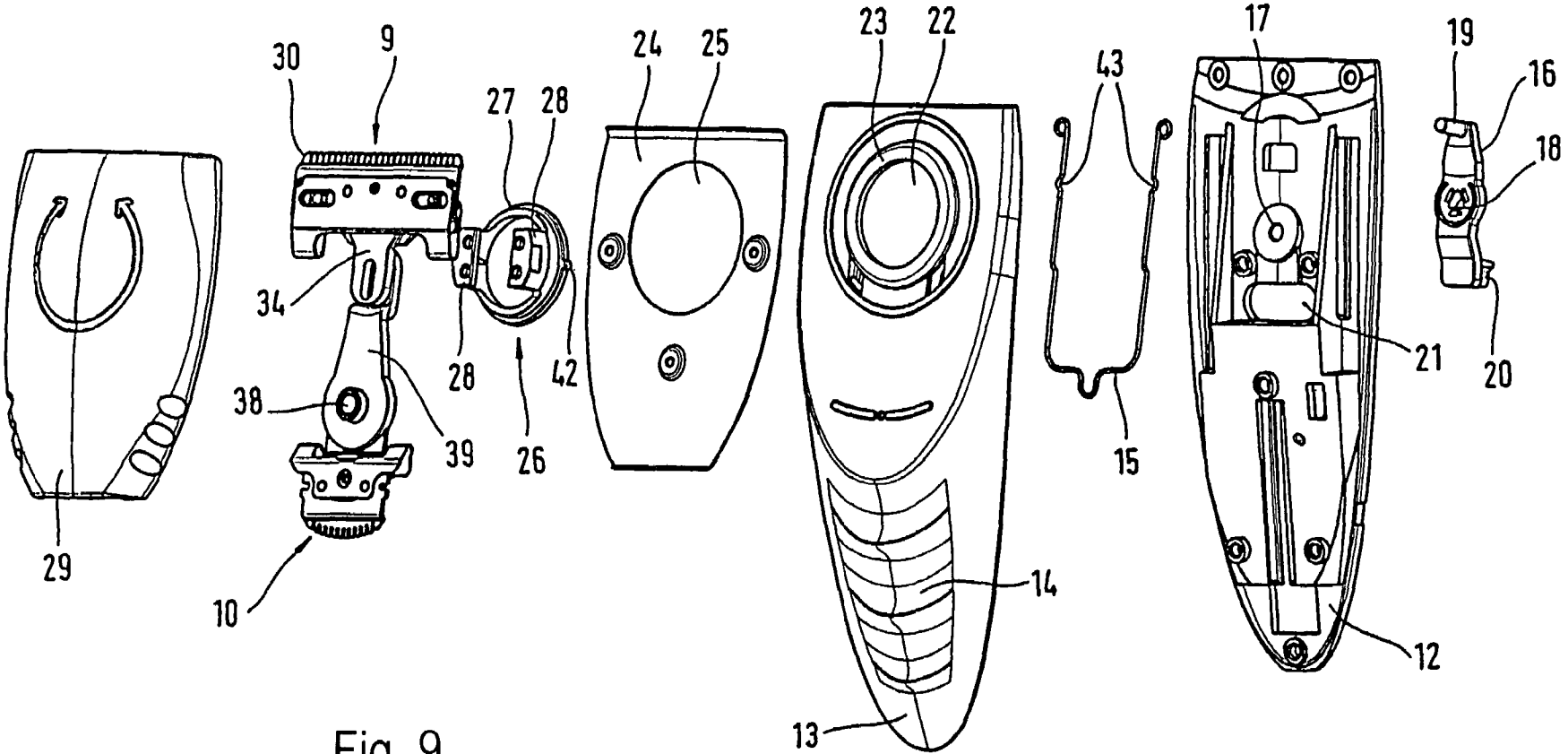
FIG. 9 is an exploded view of the carrier body and the slide switch assembly.

The construction of the module assembly, which includes the slide switch 7 and the carrier body 8 is illustrated in FIGS. 7-9. The slide switch 7 includes a backing plate 12 and a cover shell 13 provided with recessed grips 14. The backing plate 12 serves to mount the switch longitudinally displaceably on the casing 2. A U-shaped spring 15 is provided between the backing plate 12 and the cover shell 13. A double lever 16 is mounted on the backing plate 12. The backing plate 12 has a mounting point 17 to which the double lever 16 can be mounted for rotation on its central swivel bearing 18. A drive pin 19 is provided at the upper end of the double lever 16. The drive pin 19 extends transversely in the direction of the cover shell 13. Coupling projections 20 are provided at the lower end of the double lever 16. The coupling projections 20 extend transversely in a direction opposite to that of the drive pin 19, i.e., toward the casing 2.

In this arrangement, the coupling projections 20 pass through an oval aperture 21 provided in the backing plate 12. The upper third of the cover shell 13 includes a circular cutout 22, which, in an assembled state, surrounds the drive pin 19. The cutout 22 extends concentrically about the drive pin 19 when the double lever 16 is in the intermediate position illustrated in FIGS. 7-9. The cutout 22 is bounded by a circumferential collar 23 that serves as a support for the mounting plate 24. The mounting plate 24 has a circular cutout 25 of a diameter corresponding to (e.g., substantially equal to) the diameter of the cutout 22 of the cover shell 13. The mounting plate 24 and the cover shell 13 are pivotally connected with each other via a swivel joint 26. The swivel joint 26 includes a bearing ring 27 on which two diametrically opposite and axially extending domed mounting members 28 are formed. While the mounting plate 24 engages the collar 23 on the front side of the cover shell 13, the bearing ring 27 of the swivel joint 26 contacts the collar 23 on the rear or inner side of the cover shell 13. In this arrangement, the domed mounting members 28 extend through both the circular cutout 22 of the cover shell 13 and the circular cutout 25 of the mounting plate 24, combining with a circumferential shoulder to centrally locate the cover shell 13 and the mounting plate 24.

As shown in FIGS. 1 and 9, the carrier body 8 includes a cover 29 and the mounting plate 24. The domed mounting members 28 of the swivel joint 26 each have two axially extending bores to receive corresponding fastening pins provided on the inside of the cover 29 of the carrier body 8.

Referring to FIGS. 7-9, the two longhair cutter units 9 and 10 are attached to the carrier body 8. The longhair cutter units 9 and 10 are held between the mounting plate 24 and the cover 29 of the carrier body 8 and are adapted to be driven by the drive pin 19 passing through the swivel joint 26. The first longhair cutter unit 9 includes a stationary cutting comb 30 and a linearly oscillating cutting blade 31. Each of the cutting comb 30 and the cutting blade 31 has a straight row of teeth. Flanks of the cutting teeth form cutting edges to cut hairs captured between the teeth. The cutting comb 30 has elongated holes 32 into which guide pins 33 extend, forming a linear bearing. The cutting blade 31 includes a coupling member 34 that has a hole mount 35 for receiving the drive pin 19. The hole mount 35 is constructed as a vertically extending oblong hole.

The second longhair cutter unit 10, whose width can be less than half the width of the first longhair cutter unit 9, similarly includes a stationary cutting comb 36 and a cutting blade 37 driven to oscillate in pivotal fashion. Tooth rows of the cutting comb 36 and the cutting blade 37 are of generally rounded construction, their radius of curvature lying roughly about a pivot point 38 of a drive lever 39 formed on the cutting blade 37. At the end of the drive lever 39 remote from the cutting blade 37 is another hole mount 40 constructed as a vertically extending oblong hole for receiving the drive pin 19. The pivot point 38 is formed by a bearing pin 41 extending from the inside of the cover 29. The two cutting combs 30 and 36 are fastened to the inside of the cover 29.

The cutting blades 31 and 37 are arranged between their associated cutting combs 30 and 36, respectively, and the mounting plate 24. The teeth of the associated cutting combs generally protrude only a small amount over the blades' rows of teeth, which can help to reduce the risk of injury to a user by the driven components.

As soon as the double lever 16 is set into oscillating motion as will be described below, the two cutting blades 31 and 37 are oscillated because they are both in engagement with the drive pin 19. By swiveling the carrier body 8 about the axis of rotation 11, one of the two longhair cutter units 9 or 10 can be moved into a working position. It is generally not necessary to turn off or disengage the drive when rotating the carrier body 8 about the axis of rotation because the drive pin 19 oscillating about the swivel bearing 18, due to its central location relative to the swivel joint 26, can continue to drive the two cutting blades 31 or 37 or can move freely within its hole mounts 35 and 40.

When the carrier body 8 is swiveled through 90° from the initial position shown in FIG. 8, the amplitude of the movements of the cutting blades 31 or 37 will decrease to zero, because the dimensions of the hole mounts 35 and 40 coincide with the oscillating motion of the drive pin 19 which moves freely to and fro within the hole mounts 35 and 40. If the swiveling motion of the carrier body 8 continues, that is, from 90° to 180°, the oscillation amplitude of the cutting blades 31 and 37 will increase again until, upon being swiveled through 180°, they have again reached their maximum value.

To lock the carrier body 8 in the two working positions shown in FIGS. 1-6, two radially projecting cams 42 are provided on the bearing ring 27 of the swivel joint 26, as shown in FIG. 9. The cams 42, in these working positions, make locking engagement with notches 43 provided on the legs of the U-shaped spring 15. Because the swivel joint 26 rotates with the carrier body 8, on rotation of the carrier body 8, the cams 42 are able to move freely into and out of locking engagement with the notches 43 through elastic deformation of the U-shaped spring 15.

Figure 2:
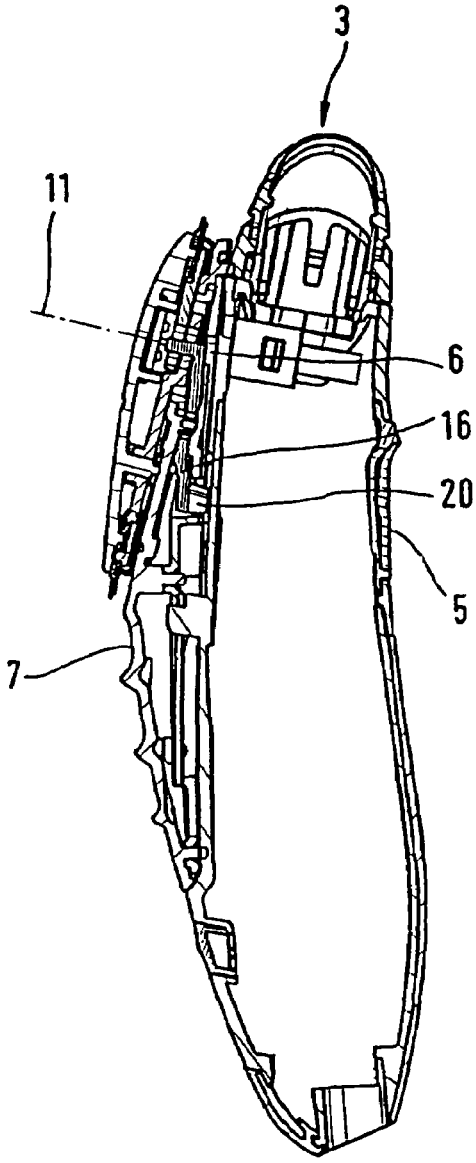
FIG. 2 is a longitudinal sectional view of FIG. 1.

FIGS. 1 and 2 show the dry shaver 1 in its initial position. Actuation of the on/off switch 5 sets the motor (not shown) in operation and drives the undercutter (not shown) beneath the outer cutter or shaving foil 4 in an oscillating manner. At the same time, the drive element 6, which projects a small amount from the casing 2, oscillates transversely to the casing 2, i.e., oscillates in the same direction as the undercutters. In this state, the shorthair cutter unit 3 is actuated so that it is able to cut hair, and the two longhair cutter units 9 and 10 are not driven, e.g., the cutting blades 31 and 37 of the cutter units 9 and 10, respectively, experience substantially no movement relative to their associated cutting combs 30 and 36, respectively. The first longhair cutter unit 9, in this arrangement, lies at a level below the shorthair cutter unit 3 so that a clear view of the latter's working area can be achieved.

Figure 3:
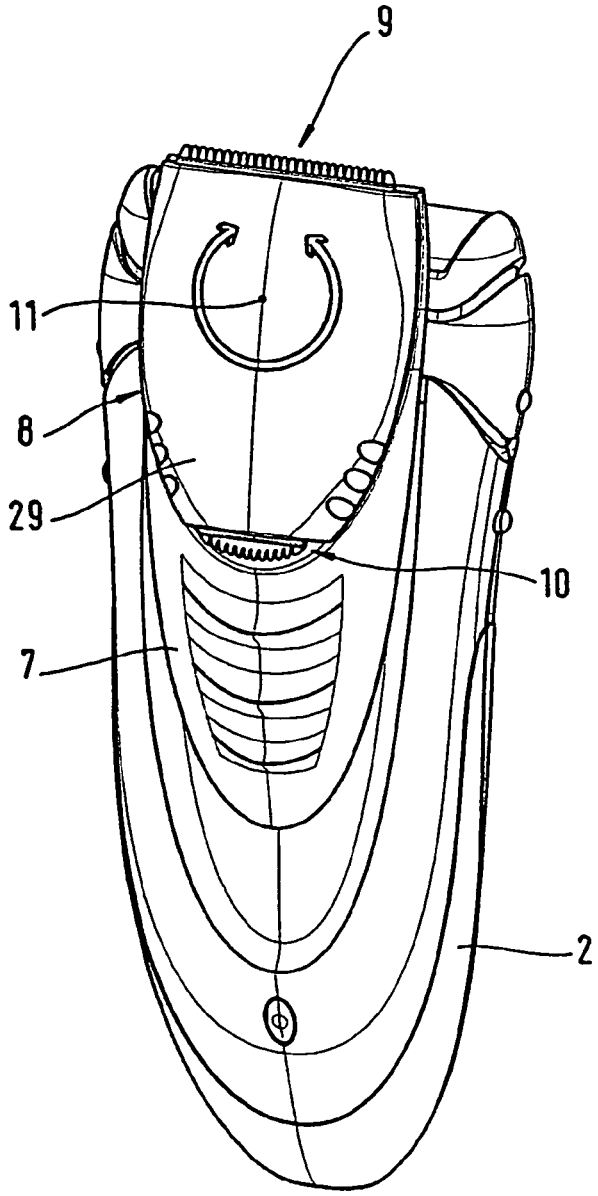
FIGS. 3 and 4 are, respectively, a view of the embodiment in a second operating state and a longitudinal sectional view thereof.
Figure 4:
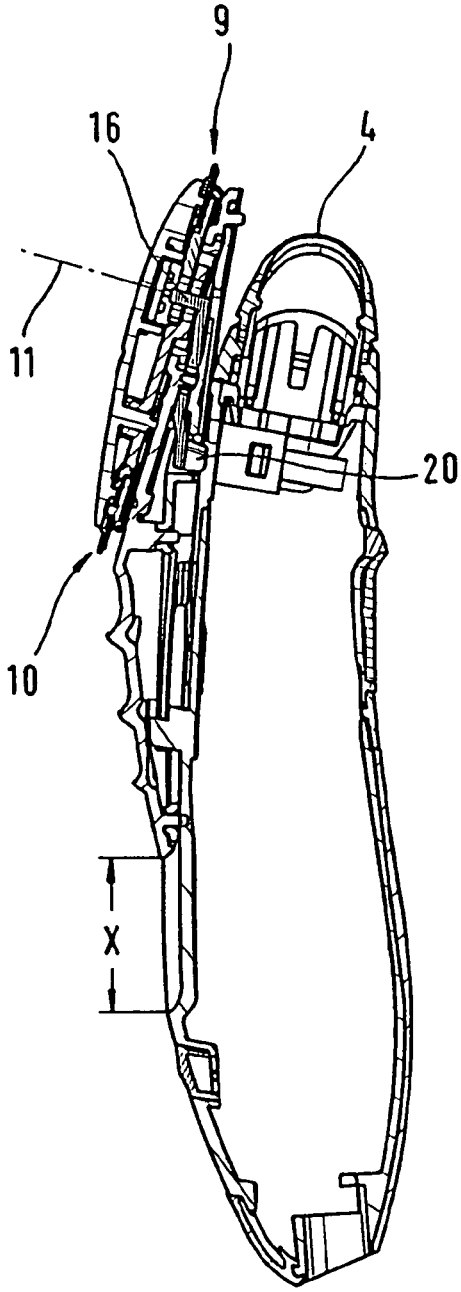

Referring to FIGS. 3 and 4, by sliding the slide switch 7 upwards relative to and lengthwise to the casing 2 by a distance X, the drive element 6 enters the space between the coupling projections 20 of the double lever 16. After sliding the distance X, which is the distance between stops on the casing 2 and on the slide switch 7, the double lever 16, driven by the drive element 6, oscillates about the mounting point 17, i.e., the swivel bearing 18. In this second operating state of the hair cutting apparatus 1, the cutting blade 31 performs an oscillatory linear motion relative to the cutting comb 30, and the cutting blade 37 performs an oscillatory pivotal motion relative to the cutting comb 36 about the pivot point 38. In this second operating state, the first, relatively wide longhair cutter unit 9 is directed upwards, extending over and beyond the shorthair cutter unit 3. The first longhair cutter unit 9, in this position, can be used to remove or precut relatively long hair which subsequently can be better captured and shaved off by the shorthair cutter unit 3 if desired. Owing to the exposed position of the first longhair cutter 9, a clear view of the first longhair cutter unit 9 can be achieved and thus the ease of use the apparatus can be increased.

Figure 5:
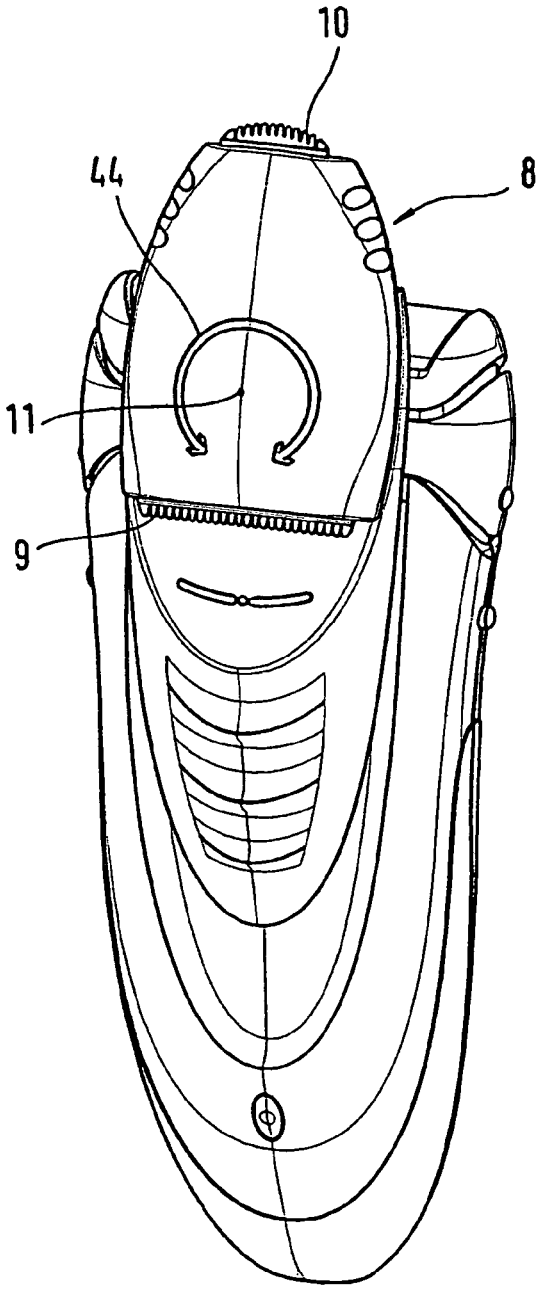
FIGS. 5 and 6 are, respectively, a perspective and a longitudinal sectional view of the embodiment of the invention in a third operating state.
Figure 6:
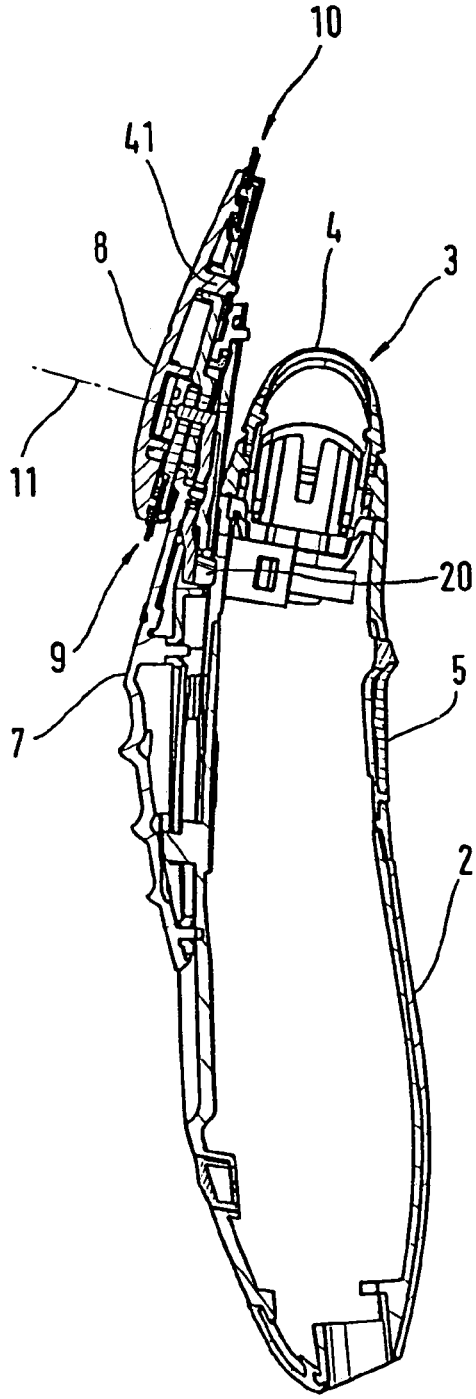

FIGS. 5 and 6 illustrate a third operating state in which the second longhair cutter unit 10 is moved into a working position. In this operating state, the slide switch 7 is in its upper switch position as shown in FIGS. 3 and 4. In contrast to the second operating state, the carrier body 8 and the cutting elements attached to the carrier body 8 are rotated about the axis of rotation 11 through 180° relative to the side switch 7 or the casing 2. In this manner, the second, relatively narrow longhair cutter unit 10 can be rotated to its working position, as illustrated by graphic 44. The relatively narrow longhair cutter unit 10 can serve as a precision shaper, e.g., for shaping beards. Considering that the axis of rotation 11 is in an eccentric relationship to the position of the two longhair cutter units 9 and 10 and considering further that the distance between the second longhair cutter unit 10 and the axis of rotation 11 is about double the distance between the axis A rotation 11 and the first longhair cutter unit 9, in the third operating state shown in FIGS. 5 and 6 the second longhair cutter unit 10 protrudes over and beyond the shorthair cutter unit 3 a more significant amount than does the first longhair cutter unit 9 in the second operating state illustrated in FIGS. 3 and 4. As a result, when using the second longhair cutter unit 10, the operator can have a substantially clear view of the cutting operation.

In some embodiments, the pivotal movement of the carrier body 8 and/or the longitudinal displacement of the slide switch 7 can be performed by control drives that the operator can control via appropriate switching elements.

Other embodiments are within the scope of the following claims.

What is claimed is:

1. An electric hair cutting apparatus, comprising:

a casing;

a slide switch linearly displaceably mounted on the casing;

a shorthair cutter unit mounted on the casing and configured to be driven by a drive motor;

a carrier body pivotally mounted on an outer surface of the slide switch and separate from the shorthair cutter unit, the carrier body being pivotable about an axis of rotation extending substantially perpendicularly to the outer surface of the slide switch; and at least one cutter unit secured to the carrier body and comprising at least two shaving elements configured to be moved relative to one another by the drive motor.

2. The apparatus of claim 1, further comprising a drive mechanism that actuates at least one of the shaving elements of the at least one cutter unit secured to the carrier body to oscillate in pivotal fashion about an axis.

3. The apparatus of claim 1, wherein the at least one cutter unit includes a cutting comb and an associated cutting blade.

4. The apparatus of claim 1, wherein the at least one cutter unit comprises two cutter units secured to the carrier body.

5. The apparatus of claim 4, wherein the two cutter units are secured to the carrier body substantially opposite one another.

6. The apparatus of claim 4, wherein the axis of rotation extends eccentrically relative to the two cutter units.

7. The apparatus of claim 4, wherein each of the two cutter units includes a cutting comb and a cutting blade.

8. The apparatus of claim 4, wherein one of the cutter units has a width that differs from a width of another of the cutter units.

9. The apparatus of claim 4, wherein the two cutter units are configured to be actuated by a common drive mechanism.

10. The apparatus of claim 4, wherein the two cutter units secured to the carrier body comprise a first longhair cutter unit having a straight row of teeth; and a second longhair cutter unit having a curved row of teeth defining a radius of curvature from a pivot point about which the second longhair cutter unit oscillates.

11. The at least one apparatus of claim 1, wherein the cutter unit secured to the carrier body becomes engaged to be driven by the motor as the slide switch is displaced linearly toward the shorthair cutter unit.

12. The apparatus of claim 11, comprising a drive element coupled to the motor; and a cutter unit drive mechanism that includes a pair of projections spanning a space that receives the drive element as the slide switch is displaced linearly toward the shorthair cutter unit.

13. The apparatus of claim 1, wherein at least one of the shaving elements of the at least one cutter unit secured to the carrier body is driven to oscillate with an oscillation amplitude that varies with swivel angle of the carrier body.

* * * * *

UNITED STATES PATENT AND TRADEMARK OFFICE

CERTIFICATE OF CORRECTION

PATENT NO. : 7,503,117 B2
APPLICATION NO. : 11/325114
DATED : March 17, 2009
INVENTOR(S) : Matthias Wetzel et al.

It is certified that error appears in the above-identified patent and that said Letters Patent is hereby corrected as shown below:

Column 7, Claim 11, Line 4
Delete “at least one” before “apparatus”

Column 7, Claim 11, Line 4
Insert --at least one-- between “wherein the” (second occurrence) and “cutter”

Signed and Sealed this

Sixteenth Day of June, 2009

JOHN DOLL
*Acting Director of the United States Patent and Trademark Office*